US006575072B2

(12) United States Patent
Pellerin

(10) Patent No.: US 6,575,072 B2
(45) Date of Patent: Jun. 10, 2003

(54) EXPANSION JOINT WITHIN AN ANCHOR RODE

(76) Inventor: Gilles Pellerin, R.R. #4, Little Pond, Souris, Prince Edward Island (CA), C0A 2B0

( * ) Notice: Subject to any disclaimer, the term of this patent is extended or adjusted under 35 U.S.C. 154(b) by 0 days.

(21) Appl. No.: 09/985,230

(22) Filed: Nov. 2, 2001

(65) Prior Publication Data

US 2002/0053277 A1 May 9, 2002

(51) Int. Cl.[7] ..... D04K 1/12
(52) U.S. Cl. ..... 87/6; 87/8
(58) Field of Search ..... 28/141; 87/2, 6, 87/13, 29, 30, 62; 114/230.2, 230.22

(56) References Cited

U.S. PATENT DOCUMENTS

| | | | | |
|---|---|---|---|---|
| 4,036,101 A | | 7/1977 | Burnett | 87/8 |
| 4,258,608 A | * | 3/1981 | Brown | 87/6 |
| 4,426,908 A | | 1/1984 | Ullmann | 87/6 |
| 4,534,262 A | | 8/1985 | Swenson | 87/6 |
| 4,597,351 A | | 7/1986 | Brainard | 114/230 |
| 5,483,911 A | | 1/1996 | Kubli | 114/230 |

FOREIGN PATENT DOCUMENTS

| | | |
|---|---|---|
| CA | 370382 | 12/1937 |
| CA | 1087930 | 10/1980 |
| CA | 1147637 | 6/1983 |

* cited by examiner

*Primary Examiner*—John J. Calvert
*Assistant Examiner*—Shaun R Hurley
(74) *Attorney, Agent, or Firm*—Mario Theriault

(57) ABSTRACT

The extensible segment in an anchor rode comprises a rubber core enclosed in a base rope along the central axis of the base rope. A braided cover further encloses an intermediate portion of the rubber core inside the base rope. The braided cover is made of braided cover strands embedded in the rubber core, and un-braided cover strands extending over the two ends of the rubber core. The un-braided cover strands are weaved into the base rope to retain the rubber core longitudinally inside the base rope.

12 Claims, 4 Drawing Sheets

EXPANSION JOINT WITHIN AN ANCHOR RODE

FIELD OF THE INVENTION

This invention pertains to mooring ropes and cables and more particularly it pertains to an anchor rode having an extensible segment built therein and a method for manufacturing this extensible segment.

BACKGROUND OF THE INVENTION

Stretchable cordage are used as mooring cables and anchor rodes for partly absorbing the stresses caused by wave actions on small boats, on buoys or on similar floating structures, for preventing damage to these crafts and floating structures and for preventing the loosening of their anchors. Stretchable cordage are also used as tow ropes for dampening the shocks of pulling an object from rest. Some of the stretchable cordage of the prior art are described in the following documents:

U.S. Pat. No. 4,258,608 issued on Mar. 31, 1981 to John L. Brown;

U.S. Pat. No. 4,426,908 issued on Jan. 24, 1984 to Martin Ullmann;

U.S. Pat. No. 4,534,262 issued on Aug. 13, 1985 to Richard C. Swenson;

U.S. Pat. No. 4,597,351 issued on Jul. 1, 1986 to Edward C. Brainard, II;

U.S. Pat. No. 5,483,911 issued on Jan. 16, 1996 to Ronald N. Kubli, and

CA 1,087,930 issued on Oct. 21, 1980 to Bertil Brandt.

Generally, the stretchable ropes of the prior art are made of a rubber rod or tube enclosed in the central portion of a rope. A tension on the rope causes the braided outside layer of the rope to compress the rubber core radially, which causes the rope to elongate, thus providing the rope with elastic properties. The length and diameter of the rubber core is proportional to these elastic properties.

An anchor rode is often partially wound on a capstan or around sheaves, and has shackles or knots at both ends thereof. Therefore, an anchor rode needs to be non-elastic along the segments thereof which are used for tying and along the segments susceptible to slippage and sharp bending. Hence, it is often desirable to make only a short segment of the anchor rode extensible as opposed to its full length.

In the past, this characteristic has raised difficulties in preventing the longitudinal movements of rubber core inside the base rope during repeated elongations and retractions of the rope. The methods of the prior art to retain the rubber core inside the base rope consists of using high strength tape and ring clips to squeeze the base rope at each end of the rubber core. It is believed that theses tapes and clips are subject to deterioration from fatigue stress and exposure to the harsh environment in which these ropes are used. Consequently, the ropes must be inspected often and repaired in order to maintain their integrity.

Moreover, the rubber cores in the stretchable ropes of the prior art are generally not subject to elongation with the outside layer of the base rope. The relative movement of the outside braided layer over the rubber core during repeated elongations and retractions causes friction and wear of the outside braided layer and of the rubber core. It will be appreciated that all relative movements between the outside braided layer and the rubber core have an adverse effect on the useful life of the rope.

Although the elastic cordage of the prior art deserve undeniable merits, it is believed that a need still exists for an extensible segment in an anchor rode, in which the rubber core does not move inside the braided outside layer of the base rope and consequently reduces the friction wear inside the base rope in order to prolong the useful life of the anchor rode.

SUMMARY OF THE INVENTION

In the present invention, there is provided an extensible segment in an anchor rode in which the rubber core is held longitudinally along the central axis of the base rope, to reduce friction related wear of the base rope and of the rubber core.

Broadly, the extensible segment in an anchor rode comprises a rubber core enclosed in a braided base rope along the central axis of the base rope. A braided cover further encloses an intermediate portion of the rubber core inside the base rope. The braided cover is made of braided cover strands embedded in the rubber core, and un-braided cover strands extending over the two ends of the rubber core. The un-braided cover strands are weaved into the base rope to retain the rubber core longitudinally inside the base rope.

The extensible segment according to the present invention is advantageous to disperse peak load in an anchor rode. Its construction prevents the rubber core to move along the base rope during repeated elongation and retractions of the rope, and enhances the resiliency of the extensible segment by applying tension as well as compression stresses to the rubber core. Friction generated by relative movement between the rubber core and the base rope is practically eliminated due the encapsulated braided cover being in contact with the braids of base rope.

Still another feature of the present invention is that it is susceptible of a low cost of manufacture with regard to both materials and labour, and which accordingly is then susceptible of low prices of sale to the consumer, thereby making such extensible segment economically available to the public.

Other advantages and novel features of the present invention will become apparent from the following detailed description.

BRIEF DESCRIPTION OF THE DRAWINGS

One embodiment of this invention is illustrated in the accompanying drawings, in which like numerals denote like parts throughout the several views, and in which.

DETAILED DESCRIPTION OF THE PREFERRED EMBODIMENT

Figure 1:
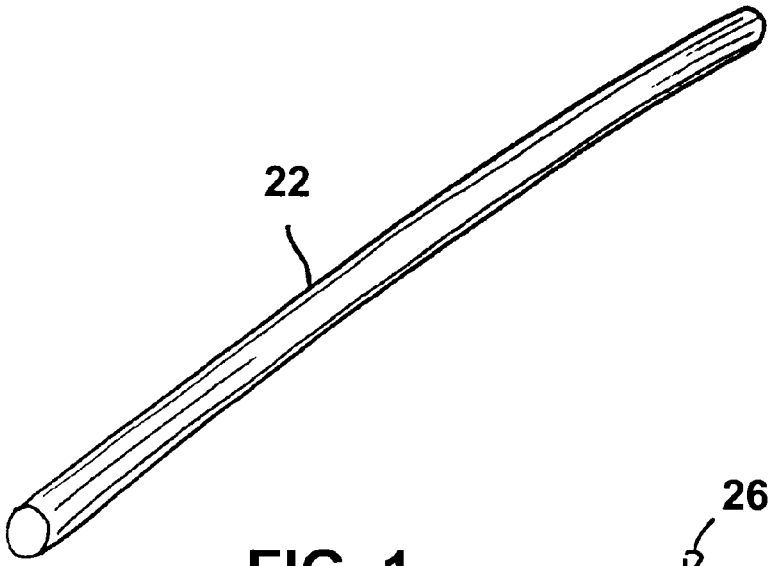
FIG. 1 is a perspective view of a rubber rod used to manufacture the extensible segment according to the preferred embodiment of the present invention.

While this invention is susceptible of embodiments in many different forms, there is shown in the drawings and will be described in details herein a specific embodiment, with the understanding that the present disclosure is to be considered as an example of the principles of the invention and is not intended to limit the invention to the embodiment illustrated and described.

Referring to FIGS. 1–7, the extensible segment 20 in an anchor rode according to the preferred embodiment comprises broadly, a rubber rod 22 encapsulated in a braided cover 24. The braided cover 24 is embedded into the surface of the rubber rod 22. The encapsulated rubber rod 26 forms the core of the extensible segment of a base rope 28. The strands 30 of the braided cover 24, at both ends of the encapsulated rubber rod 26, are weaved into and with the braids 32 of the base rope 28 for retaining the rubber rod 22 firmly into and along the base rope 28.

The preferred extensible segment 20 in an anchor rode comprises a rubber rod 22 having a diameter of about twenty-five (25) mm., and a length of about five (5) meters.

The preferred braided cover 24 embedded into the surface of the rubber rod 22 is made of high module polyethylene fibers which are applied at maximum pitch angle. The preferred braiding is referred to in the industry as twenty-four (24) carrier by two (2) ply, meaning there are forty-eight (48) strings of fibers that are paired; one half are left-handed, the other half are right-handed.

The preferred base rope 28 in which the rubber rod 22 is inserted is a twenty-five (25) mm., twelve (12) strand rope made of high module polyethylene.

A preferred method for manufacturing the extensible segment 20 is described as follows:

A. Obtaining an extruded rubber rod 22 as represented in FIG. 1. The preferred rubber rod is crude natural rubber, non-vulcanized, and having a durometer value of seventy (70).

B. Applying a tack coat on the rubber rod 22 and allow the coat to dry.

C. Passing the rubber rod through a braiding machine, and forming the braided cover 24 at maximum pitch angle over the rubber rod 22.

Figure 2:
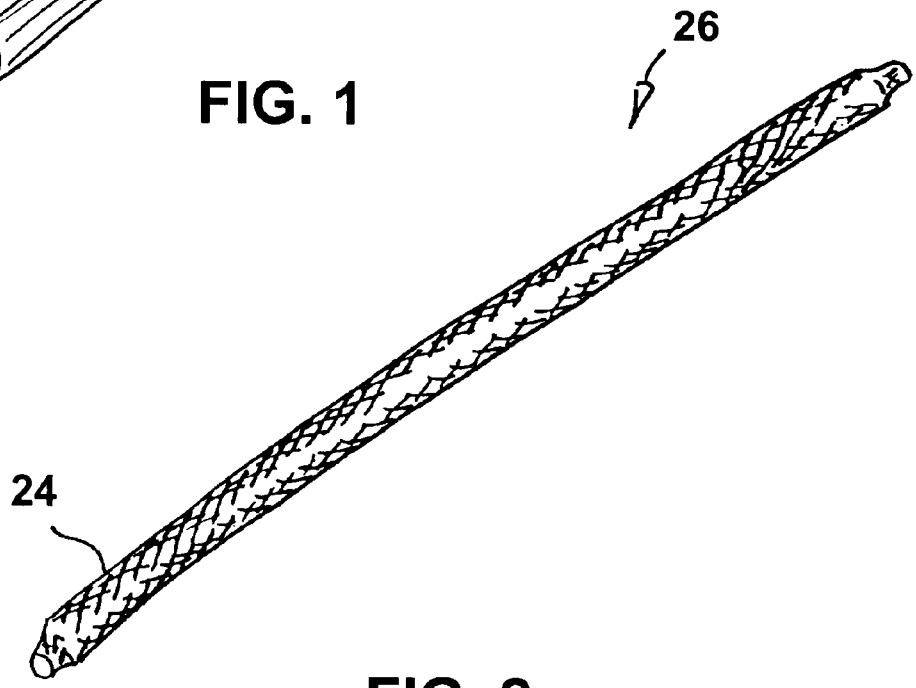
FIG. 2 is a perspective view of the rubber rod enclosed in a braided cover.

D. After the braided cover 24 is formed over the rubber rod 22, as illustrated in FIG. 2, the encapsulated rubber rod 26, is placed in an oven and vulcanized to give the rubber its resilience and to cause the fibers of the braided cover 24 to sink into and become embedded into the surface of the rubber rod 22. The encapsulated rubber rod 26 has an outside diameter of about thirty (30) mm.

E. A coat of urethane marine finish paint is then applied to the encapsulated rubber rod and is allowed to dry completely.

Figure 3:
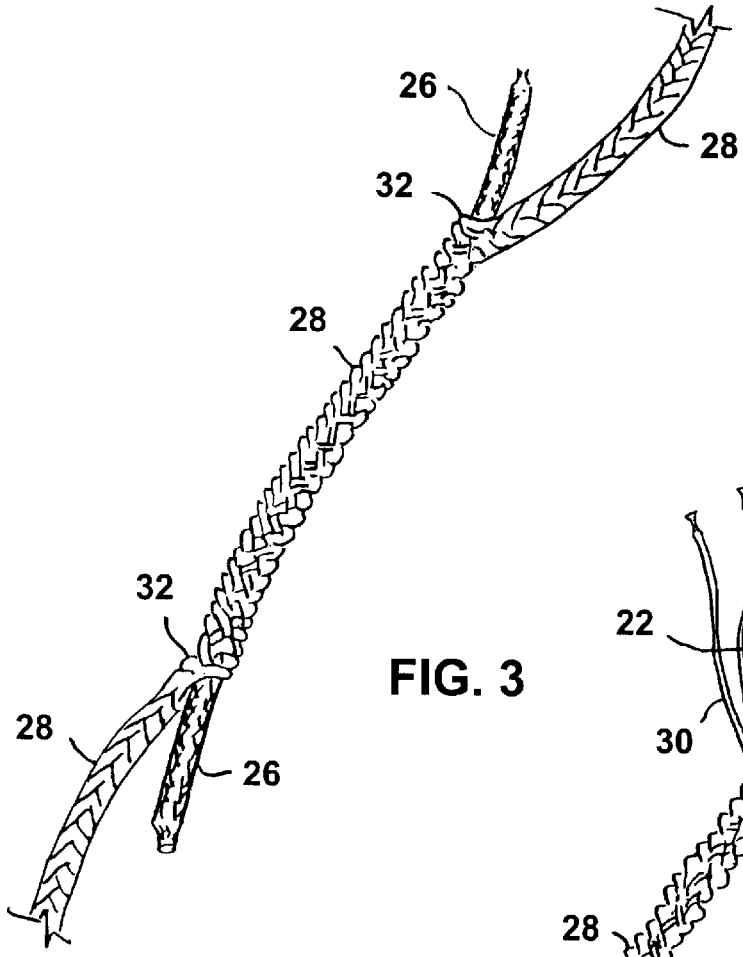
FIG. 3 is a perspective view of the encapsulated rubber rod inserted into a base rope.

F. The encapsulated rubber rod 26 is then inserted into the base rope 28 as illustrated in FIG. 3. This is achieved by squeezing the base rope like an accordion to make room for the encapsulated rubber rod 26 to fit inside the base rope, and inserting the encapsulated rubber rod through the braids 32 of the base rope 28 without cutting any of the braids 32 of the base rope 28.

Figure 4:
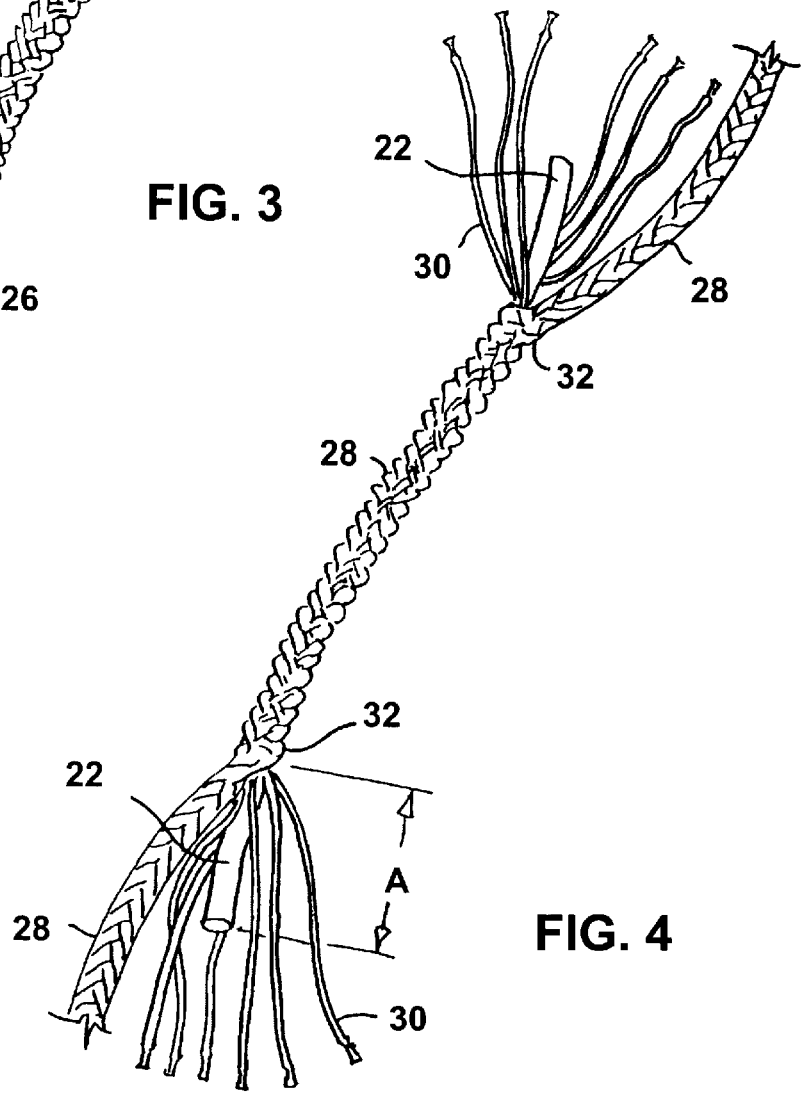
FIG. 4 is a perspective view of the encapsulated rubber rod inserted into the base rope, wherein the braided cover has been undone over a nominal distance at both ends of the rubber rod.

G. Before completely inserting the encapsulated rubber rod 26 into the based rope 28, a section 'A' of about half a meter of braiding at each end of the encapsulated rubber rod is undone to liberate six (6) strands 30 containing eight (8) strings of fibers per strand, as illustrated in FIG. 4.

H. The entire length of the encapsulated rubber rod 26 is then pulled inside the base rope 28, until the un-braided strands 30 are entirely within the base rope 28.

I. The base rope 28 is pulled tight over the encapsulated rubber rod 26 to remove and wrinkle in the base rope 28 and to smoothen the base rope 28 over the encapsulated rubber rod 26.

Figure 5:
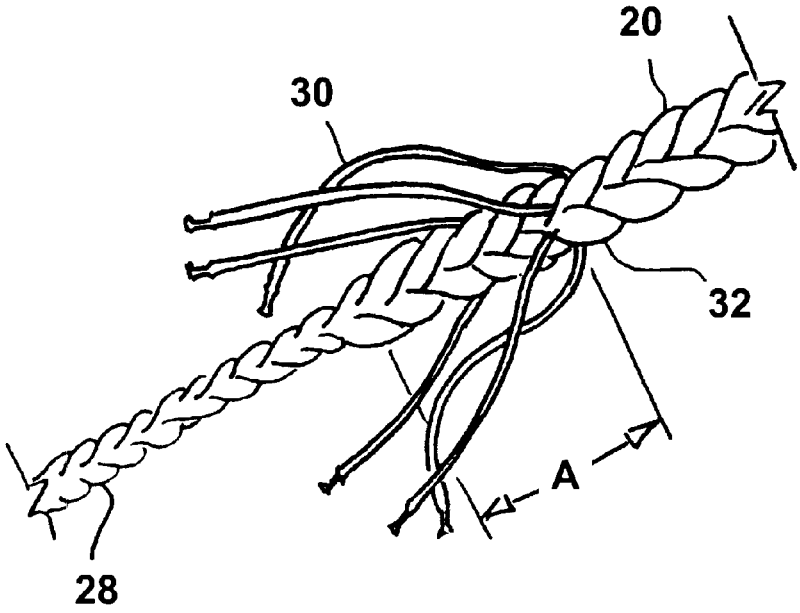
FIG. 5 is a partial view of the base rope with the encapsulated rubber rod inserted completely into the base rope, and the un-braided strands extending outside the base rope.

J. The un-braided strands 30 are then extracted from the base rope 28, as illustrated in FIG. 5, using a pointed tool. The strands 30 of the braided cover are extracted at equal intervals around the circumference of the base rope 28. The strands 30 of the braided cover are extracted through the base rope at the same place 'A' they leave the rubber rod 22.

K. Once the strands 30 of the braided cover 24 have been extracted, these are pulled firmly and evenly.

Figure 6:
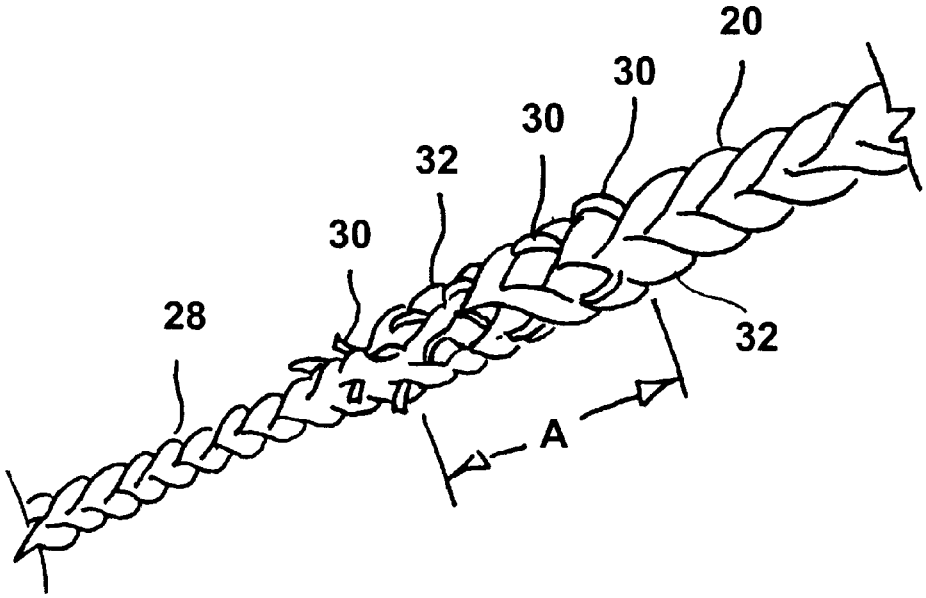
FIG. 6 is a partial view of the base rope with the encapsulated rubber rod inserted completely into the base rope, and the un-braided strands weaved into and with the braids of the base rope.

L. The six (6) un-braided strands 30 are then weaved into the base rope 28 as illustrated in FIG. 6, by a process referred to as "over and under". This process is carried out until all the un-braided strands 30 are tucked into the base rope 28.

M. The other end of the extensible segment 20 is done in a same manner by repeating the steps J, K and L.

The extensible segment 20 according to the preferred embodiment is made relatively quickly, without cutting any braid in the base rope or otherwise affecting the tensile strength of the base rope 28. The rubber rod 22 is held firmly inside the base rope 28 by the un-braided strands 30 such that there is no movement of the rubber core 22 inside the base rope 28.

Furthermore, the weaving of the strands 30 of the braided cover 24 into the braids 32 of the base rope 28 transmits some of the longitudinal stresses in the base rope 28 to the rubber rod 22 causing the rubber rod 22 to stretch with the rope. Hence the rubber rod 22 is subject to both tensile stresses and compression stresses. The stiffness of the extensible segment 20 is thereby increased.

Figure 7:
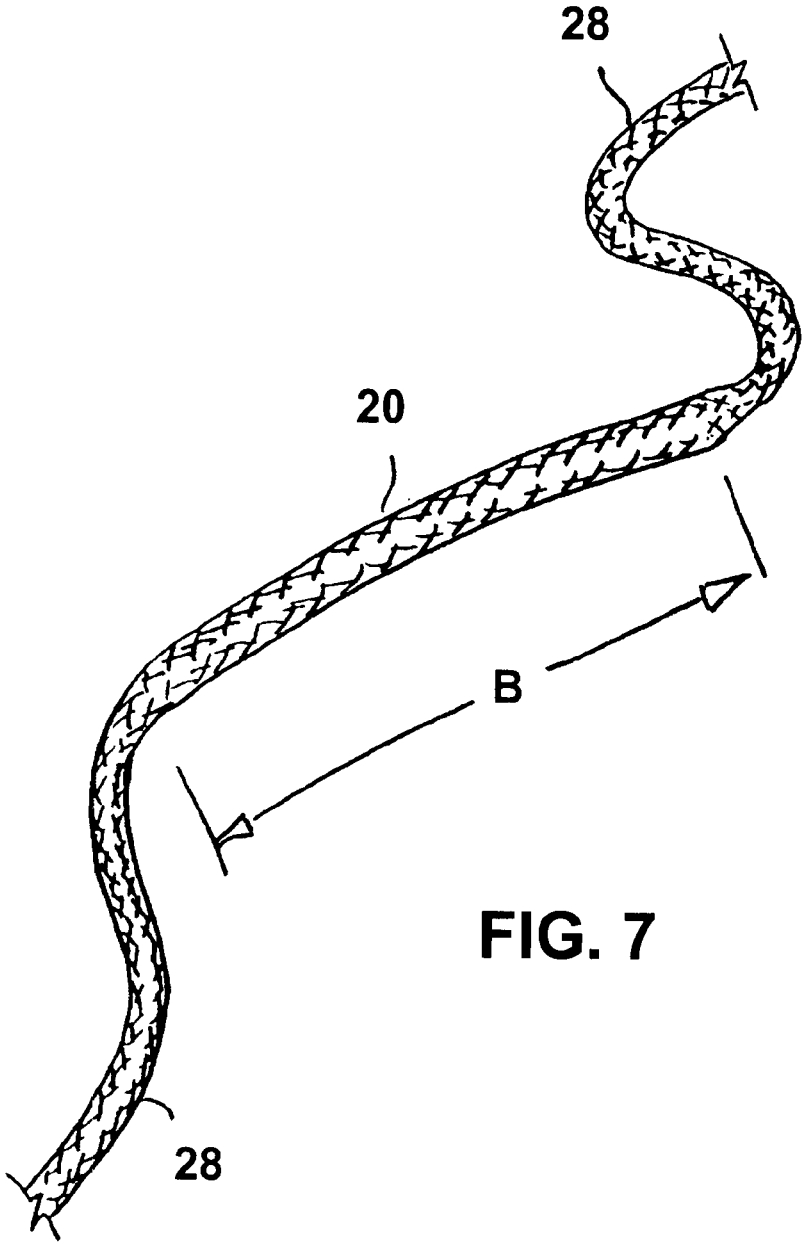
FIG. 7 is a partial view of an anchor rode having an extensible segment according to the preferred embodiment built therein.

It will be appreciated that rubber rods and base ropes with other dimensions will provide extensible segments with different properties. Therefore, a rubber rod and a base rope must be selected according to the intended purpose of the rope. The extensible segment 20 described herein with a rubber rod length 'B' of about five (5) meter, as illustrated in FIG. 7, has been found convenient for use as anchor rodes for retaining small fishing boats, small sailing crafts, buoys and floating docks.

While one embodiment of this invention has been illustrated in the accompanying drawings and described hereinabove, it will be evident to those skilled in the art that changes and modifications may be made therein without departing from the essence of this invention, as set forth in the appended claims.

I claim:

1. An extensible segment in an anchor rode, comprising:

a rubber core having a diameter and a length defining two ends;

a braided cover enclosing an intermediate portion of said rubber core; said braided cover being made of braided cover strands embedded in said rubber core, and un-braided cover strands extending over said two ends of said rubber core, and a braided base rope made of braided base rope strands;

said rubber core and said braided cover being mounted inside said base rope along a central axis of said base rope; said un-braided cover strands being weaved into and with said base rope strands for retaining said rubber core longitudinally inside said base rope, and for transmitting tensile stress in said base rope to said rubber core.

2. The extensible segment as claimed in claim 1, wherein said diameter is about twenty five millimeter and said length is about five meter.

3. The extensible segment as claimed in claim 1, wherein said braided cover is made of high module polyethylene fibers.

4. The extensible segment as claimed in claim 3, wherein said base rope has a diameter of twenty-five millimeter, is made of high module polyethylene fibers, and has twelve of said base rope strands.

5. The extensible segment as claimed in claim 4, wherein said braided cover comprises eight un-braided cover strands at each of said ends.

6. The extensible segment as claimed in claim 1, wherein said braided cover and said rubber core are enclosed inside an intermediate portion of said base rope.

7. The extensible segment as claimed in claim 3, wherein said fibers are braided at maximum pitch angle.

8. A method for manufacturing an extensible segment in an anchor rode comprising the steps of:

providing a braided base rope;

providing an extruded rubber rod made of crude natural rubber, non-vulcanized, and having a durometer value of about seventy;

applying a tack coat on said rubber rod and allow said tack coat to dry;

passing said rubber rod through a braiding machine, and forming a braided cover over said rubber rod, thereby forming an encapsulated rubber rod;

vulcanizing said encapsulated rubber rod and causing said braided cover to become embedded in said rubber rod;

applying a coat of urethane marine finish paint over said encapsulated rubber rod and allowing said paint to dry;

partly inserting said encapsulated rubber rod into said braided base rope;

undoing a braiding in said braided cover at each end of said encapsulated rubber rod, and liberating six braided cover strands at each end of said encapsulated rubber rod;

enclosing said encapsulated rubber rods and said braided cover strands completely inside said base rope;

smoothing said base rope over said encapsulated rubber rod;

extracting said braided cover strands from said base rope, and weaving said braided cover strands into said base rope.

9. The method as claimed in claim 8, wherein said rubber rod has a length of about five meter and said step of undoing the braiding of said braided cover is done over a distance of about half a meter.

10. The method as claimed in claim 8, wherein said steps of inserting said encapsulated rubber rod is effected in an intermediate portion of said base rope.

11. The method as claimed in claim 9, wherein said step of weaving said braided cover strands into said base rope is effected over said distance.

12. The method as claimed in claim 8, wherein said step of forming a braided cover over said rubber rod is effected at maximum pitch angle.

* * * * *